US006426727B2

(12) United States Patent
Gilbert

(10) Patent No.: US 6,426,727 B2
(45) Date of Patent: Jul. 30, 2002

(54) DIPOLE TUNABLE RECONFIGURABLE REFLECTOR ARRAY

(75) Inventor: Roland Gilbert, Milford, NH (US)

(73) Assignee: BAE Systems Information and Electronics Systems Integration Inc., Nashua, NH (US)

( * ) Notice: Subject to any disclaimer, the term of this patent is extended or adjusted under 35 U.S.C. 154(b) by 0 days.

(21) Appl. No.: 09/844,950

(22) Filed: Apr. 27, 2001

Related U.S. Application Data

(60) Provisional application No. 60/200,783, filed on Apr. 28, 2000.

(51) Int. Cl.[7] ..... H01Q 1/38
(52) U.S. Cl. ..... 343/755; 343/912
(58) Field of Search ..... 343/700 MS, 754, 343/909, 912, 755; H01Q 1/38

(56) References Cited

U.S. PATENT DOCUMENTS 4,684,952 A * 8/1987 Munson et al. ..... 343/700 MS
4,905,014 A 2/1990 Gonzalez et al. ..... 343/909
5,451,969 A 9/1995 Toth et al. ..... 343/781 CA
5,864,322 A 1/1999 Pollon et al. ..... 343/909
6,031,506 A * 2/2000 Cooley et al. ..... 343/840
6,081,235 A * 6/2000 Romanofsky et al. ..... 343/700 MS
6,198,457 B1 3/2001 Walker et al. ..... 343/840

* cited by examiner

*Primary Examiner*—Michael C. Wimer
(74) *Attorney, Agent, or Firm*—Salzman & Levy

(57) ABSTRACT

The present invention provides a low-cost, frequency-tunable, steerable, reflector array capable of simulating the electromagnetic effects of a parabolic or similarly-shaped reflector on a planar or conformal surface. Simple scatterers such as short circuited dipoles, disposed on a geometrically planar or conformal substrate, are configured from a series of scatterer sub-elements, electrically connected serially to one another by MEMS switches. These connected scatterer sub-elements form a reflective array disposed above a ground plane on the substrate. By properly controlling the length and spacing of the activated dipole elements, it is possible to simulate the equiphase reflection profile of a horn feed or sub-reflector feed of a parabolic or similar reflector. In addition, the array may be steered by selectively controlling the scatterer configurations.

19 Claims, 3 Drawing Sheets

DIPOLE TUNABLE RECONFIGURABLE REFLECTOR ARRAY

RELATED APPLICATION

This application claims priority from U.S. Provisional Patent Application Serial No. 60/200,783 filed Apr. 28, 2000.

FIELD OF THE INVENTION

The present invention relates to methods and apparatus for reflecting and focusing electromagnetic radiation and, more particularly, to a low-cost, tunable, steerable, reconfigurable reflector array which simulates the electromagnetic effects of a parabolic or other non-planar reflector by means of a flat surface.

BACKGROUND OF THE INVENTION

In the field of radio frequency (RF) communications, it is often necessary and/or desirable to be able to focus, direct, or otherwise manipulate an RF signal. Traditionally this has been accomplished by placing a reflective surface in the signal path, either to gather and focus a weak signal being received or to concentrate a transmitted signal. While flat surfaces reflect RF energy, their effect is very much like an optical mirror in that they reflect an incident signal at an orthogonal angle to the angle of incidence and, consequently, perform no concentrating or focusing function. The use of a curved (e.g., a parabolic) surface, however, does provide a concentrating, focusing function.

One problem with a curved physical structure is that space must be provided to accommodate its depth. This is not always easy, especially on aircraft or spacecraft where a smooth outer surface skin may be essential. Because the operation of a parabolic or similar reflective surface is well understood, attempts have been made to simulate the function of such surfaces without the need for a physically deep structure.

U.S. Pat. No. 4,905,014 for MICROWAVE PHASING STRUCTURES FOR ELECTROMAGNETICALLY EMULATING REFLECTIVE SURFACES AND FOCUSING ELEMENTS OF SELECTED GEOMETRY, issued to Daniel G. Gonzalez, et al., provides one such solution. GONZALEZ, et al. teach a planar surface consisting of an array of elements, each functioning as both a radiator and a phase shifter. Crossed, shorted dipoles are positioned approximately ⅛ λ above a ground plane for impedance matching purposes. This distance of ⅛ λ is chosen because that is the point where signals reflected from the bottom ground plane are 90° out of phase (i.e., in quadrature). When considering phase shifts, 90° is the maximum phase shift that can occur. The tuned dipoles may be arranged to match this phase or to algebraically add to it. At this distance, neither the E nor H fields are peaking. In addition, the selected distance ensures that the signal is not out of phase with the ground plane.

Incident RF energy causes a standing wave to be set up between the elements and the ground plane. Each dipole element has an RF reactance near its resonant frequency, which, combined with the standing wave, causes radiant RF to be re-radiated with a known phase shift, controllable by the dipole's length and other specific physical parameters such as the dielectric constant of the material upon which the dipoles are supported, etc.

However, there are shortcomings of this approach. The operational parameters (i.e., operating frequency and directional characteristics) of the array are fixed. The GONZALEZ, et al. array, for example, is operable over only a relatively narrow frequency band and its directionality is fixed. The inventive array, on the other hand, utilizes microelectromechanical systems (MEM) switches or the like to control the length of the dipole elements to vary the operating frequency of the array. In addition, selective manipulation of the dipoles allows the beam to be electrically steered.

Another approach to overcome the shortcomings of the GONZALEZ, et al. apparatus is disclosed in U.S. Pat. No. 5,864,322 for DYNAMIC PLASMA DRIVEN ANTENNA, issued to Gerald E. Pollon, et al. POLLON, et al. teach a dynamically reconfigurable reflective array consisting of a series of externally-controllable gas-filled cells or plasma structures. Each cell utilizes a series of horizontal and vertical electrodes to create reflective elements in ionized regions of the cells. By controlling the size, the geometry and the spacing of the ionized regions, a reconfigurable reflective array is created.

The inventive reconfigurable reflective array varies from the of POLLON, et al. in that a much simpler technology is utilized to implement the reconfigurable elements.

It is therefore an object of the invention to provide a low-cost, reconfigurable reflective array for dynamically simulating a non-planar reflector geometry.

It is a further object of the invention to provide a low-cost, reconfigurable reflective array for dynamically simulating a non-planar reflector geometry which may selectively operate across a wide range of frequency bands.

It is an additional object of the invention to provide a low-cost, reconfigurable reflective array for dynamically simulating a non-planar reflector geometry which may be electrically steered.

It is another object of the invention to provide a low-cost, reconfigurable reflective array for dynamically simulating a non-planar reflector geometry implemented using microelectromechanical systems switches (MEMS) for implementing variable length reflective elements.

It is a still further object of the invention to provide a low-cost, reconfigurable reflective array for dynamically simulating a non-planar reflector geometry wherein MEMS devices are controlled by a radiant energy supplied by optical fibers.

SUMMARY OF THE INVENTION

In accordance with the present invention there is provided a low-cost, frequency-tunable, steerable reflector array which is capable of simulating the electromagnetic effects of a parabolic or similarly-shaped reflector on a planar or conformal surface. A series of reflective scatterer subelements, connected serially to one another by switches, is used to form a reflective array disposed above a ground plane on a flat or curved surface. Activated reflective scatterers, arranged in configurations such as dipoles, crossed dipoles or the like are used to form the reflective surface. By properly controlling the length and spacing of the activated scatterer elements, it is possible to simulate the phase front of a reflecting surface such as a parabolic, spherical, cylindrical, or other similarly shaped reflector. In addition, the array may be electrically steered by selectively controlling the reflective scatterer configurations.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

The present invention features a low-cost, frequency-tunable, steerable, reflector array that is capable of simulating, on a planar or conformal surface, the electromagnetic effects of a parabolic or similarly-shaped reflector.

Figure 1:
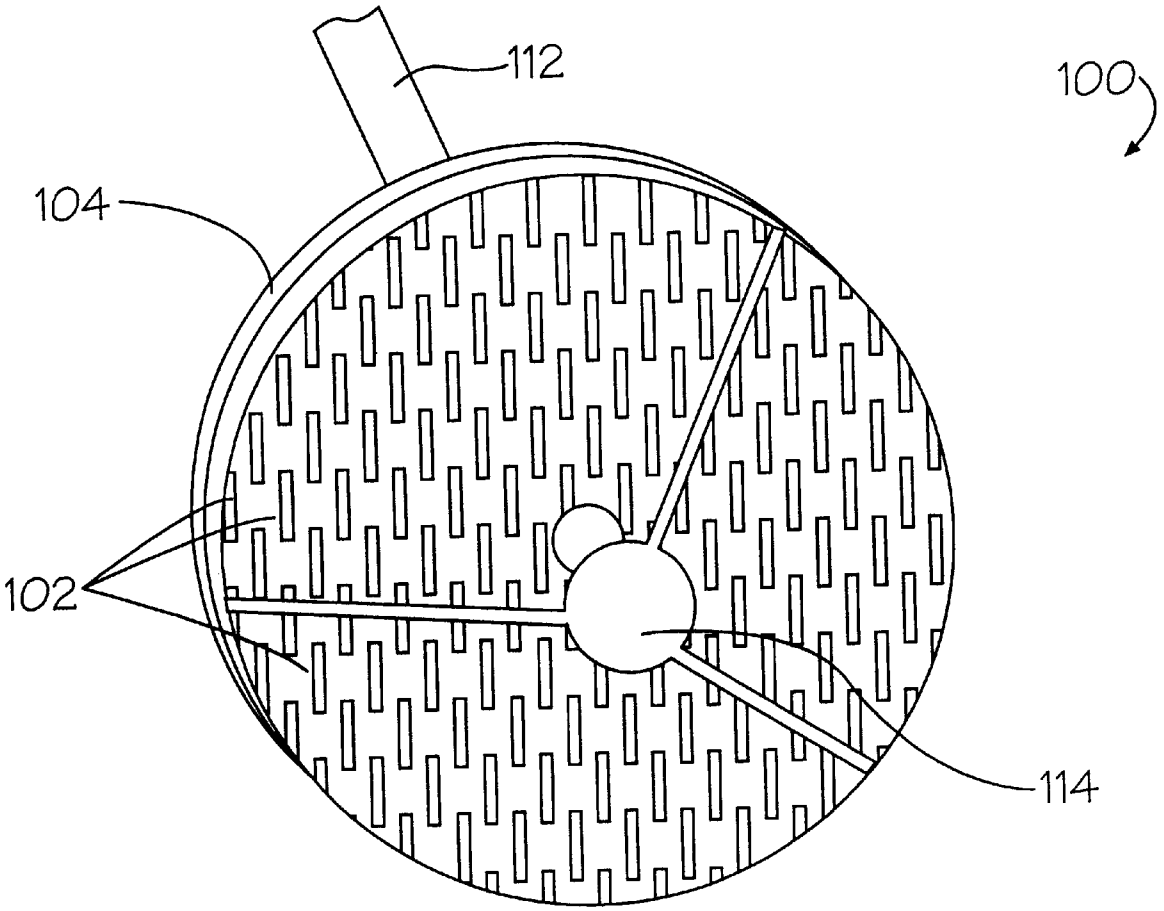
FIG. 1 is a schematic, perspective view of the reflective array of the invention.
Figure 2:
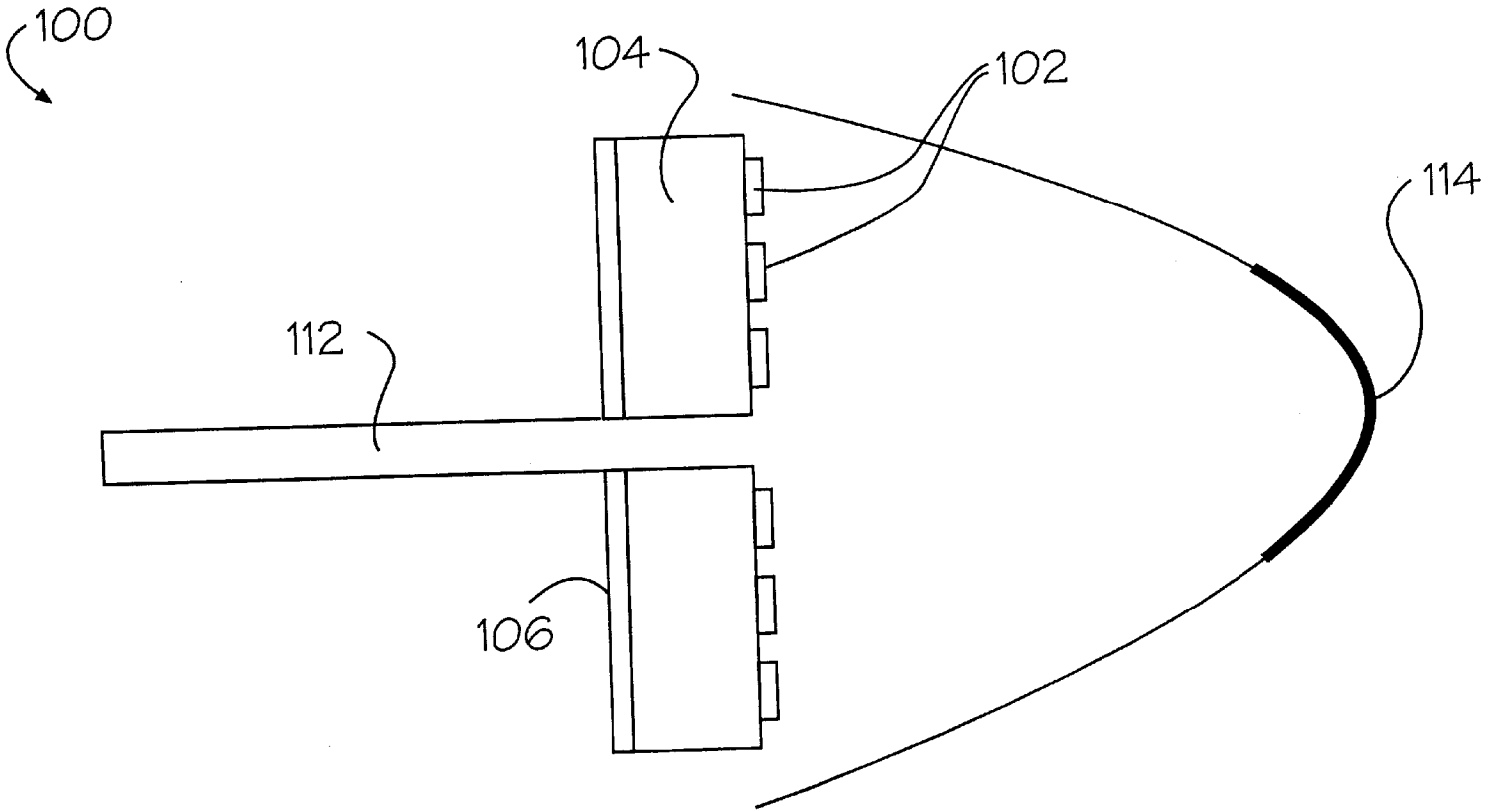
FIG. 2 is a schematic cross-sectional view of the reflective array of FIG. 1.

Referring first to FIGS. 1 and 2, there are shown perspective and cross-sectional schematic views, respectively, of a typical embodiment of the reconfigurable reflective array of the invention, generally at reference number 100. An array of configurable dipole elements 102 is disposed on the front face of a dielectric substrate 104, typically a radome. The rear face of dielectric substrate 104 is metallized to form a ground plane 106. The thickness of dielectric substrate/radome 104 is chosen to be in the range of between approximately 1/16 λ and 1/8 λ of the selected operating frequency, typically between 2 and 40 GHz. Well known semiconductor and/or micromachining techniques may be used to apply semiconductor or MEMS switches to a the dipoles 102 on substrate 104, thereby extending the realizable frequency tunability to over an octive (2:1) bandwidth. The thickness of the metallic ground plane 106 is typically in the range of between 1 and 2 mils (0.025 mm to 0.05 mm). A thin, conductive film may be utilized.

Figure 3:
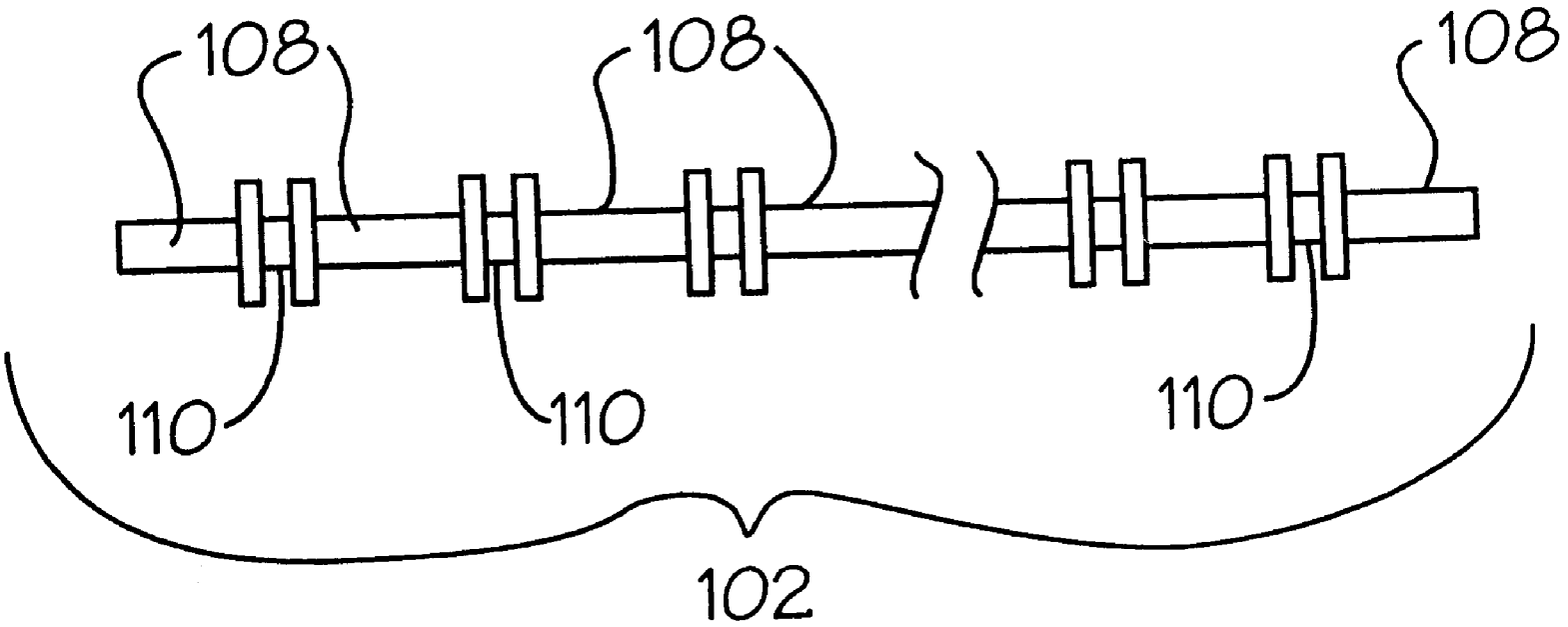
FIG. 3 is an enlarged schematic view of a MEMS switch-connected dipole element used in the reflective array of FIG. 1.

Referring now also to FIG. 3, dipole scatterer elements 102 are constructed from a series of conductive dipole sub-elements 108 connected serially to one another by switches 110. Switches 110 may be of any suitable kind such as microelectromechanical systems switches (MEMS) or light-activated semiconductor switches. While dipoles have been chosen for purposes of disclosure, it will be obvious to those skilled in the art that there are other types of reflective scatterers, such as patches, loops, etc., that may be used to practice the invention. Dipoles are particularly useful, however, because they exhibit a sharp and well defined (i.e., predictable) resonance with inductive reflectance slightly below resonance and capacitive reflectance slightly above the resonant frequency. The lengths of dipole sub-elements 108 depend upon the required operating frequency range and are typically between approximately 0.025 λ and 0.1 λ. This means that between 10 and 40 sub-elements 108 can be provided per dipole 102. The total length of dipole elements 102 is typically between 0.25 λ and 0.6 λ at the chosen operating frequency, which is dependent on other factors such as the dielectric constant of the substrate and the coupling among the array elements.

The operation of the reflective array 100 also depends, at least in part, on the width of the dipole elements 102. The dipole width affects the sharpness of the reactance curve around the resonant frequency for a given dipole length, wherein a greater dipole width provides a broader bandwidth of inductive reactance. Variations in the inductive reactance are used for producing different amounts of phase shift. Thus varying the dipole length by means of connecting the sub-elements, varies the phase shift for a signal at a given frequency. This phase shift determines the direction of coherent summation from all of the reflective elements. Thus varying the phase shift of individual elements provides for direction control of the coherently summed signals. The chosen dipole width is approximately 0.020 λ and 0.10 λ. The elements can be crossed dipoles or patches for circular polarization. A triangular array of lattice or crossed dipoles provides for more closely spacing the dual-polarized elements.

An RF waveguide feed 112 projects an RF signal through radome 104 which strikes sub-reflector 114 which, in turn, reflects the RF signal to the surface of reflective array 100. In alternate embodiments, the RF signal may be directed directly to the reflective array 100; sub-reflector 114 may be eliminated.

Incident RF energy reflected from sub-reflector 114 causes a standing wave to be established between dipole elements 102 and the ground plane 106. At any particular operating frequency, dipole elements 102 exhibit a particular reactance which, in combination with the standing wave, causes the incident RF signal to be re-radiated with a phase shift $\phi$. The value of $\phi$ is dependent upon the length of the dipole elements 102, the thickness and dielectric constant of substrate/radome 104 and the angle of incidence of the incident RF signal. In addition, phase shift $\phi$ is somewhat dependent upon mutual coupling between adjacent dipole elements 102. Heretofore, reflective arrays have been made only on flat surfaces where the mutual coupling and phase relationships between dipole elements is constant. With the availability of advanced computer modeling tools, the varying mutual coupling between elements placed on a curved surface may now be predicted accurately. This allows the creation of reflective arrays on conformal as well as flat surfaces.

In the inventive reflector design, the lengths of dipole elements 102 are controlled by creating at least some of the dipole elements 102 as segmented elements 108 selectively interconnected by optically controlled RF microelectromechanical systems (MEMS) switches 110. In this manner, dipole elements 102 may be selectively built up from multiple dipole segments 108 by closing or opening the particular MEMS switch 110. The advantages of optical fibers are that no superfluous electrical currents are introduced near the reflective array, and no additional electrical conductors are present to affect the RF signal.

The MEMS switch devices 110 typically used in this application have dimensions of approximately 200×500 $\mu$m. When packaged to included leads, their overall size is still only approximately 30×20 mils. Consequently, their size is very small compared to the wavelengths of interest. This allows for minute adjustments to the lengths of reflective elements 102 as sub-elements 108 are switched in or out to change the overall length and/or configuration of reflective elements 102.

The MEMS switches 110 may be actuated in a number of ways. Running optical fibers (not shown) to each MEMS is one activation technique well known to those skilled in the art. Another technique is to use RF actuation as described in co-pending U.S. patent application, Ser. No. 60/201,215 filed May 2, 2000, which describes a novel technique for activating MEMS devices. More conventional techniques using electrical conductors (e.g., copper wires or resistive films) to actuate the MEMS devices may also be used, of course, the actual MEMS actuation technique forming no part of the instant invention.

While most MEMS devices remain actuated only as long as voltage is applied, a new class of bi-stable MEMS devices could also be used in this application. Using bi-stable MEMS devices would allow the configuration to be set up once and the actuation signal(s) removed, leaving a stable dipole configuration.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A reconfigurable, steerable reflective array, comprising:

a) a planar dielectric substrate having a front surface, a rear surface, a predetermined thickness and a predetermined dielectric constant;

b) a metallized layer disposed upon said rear surface of said dielectric substrate;

c) reflective elements disposed on said front surface of said dielectric substrate, at least one of said reflective elements comprising at least two reflective sub-elements being selectively electrically interconnected to one another by at least one electrically conductive switch; and d) an RF signal source for providing and applying an RF signal having a predetermined range of frequencies to said reflective elements;

whereby at least some of said reflective elements re-radiate said applied RF signal in a predetermined direction and with a predetermined phase shift relative to said applied RF signal, thereby establishing an electromagnetic radiation pattern approximating a radiation pattern from a geometrically non-planar reflector.

2. The reconfigurable, steerable reflective array as recited in claim 1, wherein said geometrically non-planar reflector comprises a reflector having a substantially parabolic shape.

3. The reconfigurable, steerable reflective array as recited in claim 1, wherein said dielectric substrate has an opening therein to allow passage of said RF signal therethrough and wherein said RF signal source comprises a sub-reflector in front of said front surface of said dielectric substrate adapted to receive said applied RF signal and reflect it onto said reflective elements.

4. The reconfigurable, steerable reflective array as recited in claim 1, wherein said reflective elements comprise at least one from the group of dipoles, crossed dipoles and other reflective elements.

5. The reconfigurable, steerable reflective array as recited in claim 4, wherein said at least one electrically conductive switch comprises at least one MEMS switch.

6. The reconfigurable, steerable reflective array as recited in claim 5, wherein said MEMS switch is activated by radiant energy.

7. The reconfigurable, steerable reflective array as recited in claim 6, wherein said radiant energy comprises light from at lease one device from the group: light-emitting diode (LED) and laser.

8. The reconfigurable, steerable reflective array as recited in claim 5, wherein said at least one MEMS switch is activated by one of the group of energy sources: radio frequency energy and direct electrical connection.

9. The reconfigurable, steerable reflective array as recited in claim 6, wherein said radiant energy is conducted from said at least one device to said at least one MEMS switch by an optical fiber.

10. The reconfigurable, steerable reflective array as recited in claim 5, wherein said at least one MEMS switch comprises at least one bistable MEMS switch.

11. The reconfigurable, steerable reflective array as recited in claim 4, wherein said reflective sub-elements are selectively electrically connected to one another, one of multiple, predetermined frequency bands of operation is selected.

12. The reconfigurable, steerable reflective array as recited in claim 4, wherein said reflective sub-elements are selectively electrically connected to one another, said steerable reflective array is steered in a predetermined direction.

13. A reconfigurable, steerable reflective array comprising a planar dielectric substrate having a metallized film disposed on a rear surface thereof and a plurality of reflective sub-elements disposed in a predetermined pattern on a front surface thereof, said reflective sub-elements being selectively electrically connectable one to another by MEMS switches disposed therebetween, said reflector array being adapted to receive a radio frequency (RF) signal in a predetermined frequency band from an RF signal source disposed proximate said reflective array, whereby said reflective array re-radiates at least a portion of said RF signal in a direction controlled by a selective activation of said MEMS switches in a radiation pattern substantially equal to a radiation pattern from a geometrically non-planar reflector.

14. The reconfigurable, steerable reflective array as recited in claim 13, wherein said geometric non-planar reflector is a focusing reflector such as a parabolic reflector.

15. The reconfigurable, steerable reflective array as recited in claim 13, wherein said MEMS switches are selectively actuated by radiant energy supplied thereto via an optical fiber.

16. The reconfigurable, steerable reflective array as recited in claim 13, wherein said reflector array is steered by selectively actuating said MEMS switches.

17. The reconfigurable, steerable reflective array as recited in claim 13 adapted for operation in at least two predetermined frequency bands, said reflective array being configured for operation in a selected one of said at least predetermined frequency bands by selective activation of said MEMS switches.

18. A reconfigurable, steerable reflective array, comprising:

a) a planar dielectric substrate having a front surface, a rear surface;

b) a metallized layer disposed upon said rear surface of said dielectric substrate;

c) a multiplicity of reflective elements disposed in an array on said front surface of said dielectric substrate, said reflective elements each including at least two reflective sub-elements selectively electrically interconnectable to one another by electrically conductive switches; and wherein said reflective elements are adapted to re-radiate RF energy reflected by the metallized layer at a predetermined wavelength with a predetermined phase shift in response to selective electrical interconnection of the sub-elements, thereby establishing a controllable electromagnetic radiation pattern from the array.

19. The reconfigurable, steerable reflective array as recited in claim 18, wherein said reflective sub-elements are selectively electrically connected to one another by either light-activated semiconductor switches or MEMS.

* * * * *